United States Patent [19]

Czeschka et al.

[11] Patent Number: 4,825,541

[45] Date of Patent: May 2, 1989

[54] METHOD OF MAKING CONTACT SPRINGS

[75] Inventors: Franz Czeschka, Rechberghausen; Richard Schäfer, Wangen, both of Fed. Rep. of Germany

[73] Assignee: ERNI Elektroapparate GmbH, Adelberg, Fed. Rep. of Germany

[21] Appl. No.: 131,204

[22] Filed: Dec. 10, 1987

[30] Foreign Application Priority Data

Dec. 22, 1986 [DE] Fed. Rep. of Germany ..... 3644029

[51] Int. Cl.[4] ..... H01R 43/16

[52] U.S. Cl. ..... 29/885; 29/874; 29/862; 439/825

[58] Field of Search ..... 29/885, 874, 747, 857, 29/882; 439/825, 79, 816, 826, 828, 834

[56] References Cited

U.S. PATENT DOCUMENTS

| | | | |
|---|---|---|---|
| 3,048,812 | 8/1962 | Heidler | 439/825 |
| 3,137,645 | 6/1964 | Vaughan et al. | 29/885 X |
| 3,230,493 | 1/1966 | Jensen et al. | 439/79 |
| 3,559,604 | 2/1971 | Ruehleman et al. | 29/874 |
| 3,675,320 | 7/1972 | Watanabe | 29/874 |
| 3,707,932 | 1/1973 | Murray | 29/874 |
| 4,206,964 | 6/1980 | Olsson | 29/874 X |
| 4,480,386 | 11/1984 | Adams | 29/874 |
| 4,546,542 | 10/1985 | Proud | 29/874 |
| 4,679,318 | 7/1987 | Bright | 29/747 |
| 4,720,276 | 1/1988 | Takahashi | 29/874 X |

FOREIGN PATENT DOCUMENTS

| | | | |
|---|---|---|---|
| 1082645 | 6/1960 | Fed. Rep. of Germany | 29/874 |
| 1026212 | 6/1983 | U.S.S.R. | 29/885 |
| 1184039 | 10/1985 | U.S.S.R. | 29/857 |
| 768242 | 2/1957 | United Kingdom | 29/874 |
| 1003775 | 9/1965 | United Kingdom | 29/874 |

*Primary Examiner*—Carl J. Arbes

*Attorney, Agent, or Firm*—Toren, McGeady & Associates

[57] ABSTRACT

A method of making single-piece contact springs by continuous punching from a metal strip. Each contact spring has in the finished state two spring arms which extend symmetrically relative to each other and are connected to a common connecting member. The spring arms have each a contact bend which are directed toward and are in contact with each other. The other end of the spring has a connecting post preferably provided with a press-in portion. A gap for the later formation of the spring arms is made during one of the punching operations of the blank in the plane of the strip as a scrapless punching cut. Simultaneously with the scrapless punching operation, one of the spring arms is bent out of the plane of the strip near the connecting member and is placed by a stamping operation into a position approximately parallel to the other spring arm which remained in the plane of the strip. In a subsequent deforming operation, the contact bends are formed simultaneously in both spring arms and the spring arms are crossed over each other transversely of the plane of the strip in the region of the contact bends.

2 Claims, 3 Drawing Sheets

METHOD OF MAKING CONTACT SPRINGS

BACKGROUND OF THE INVENTION

1. Field of the Invention

The present invention relates to a method of making single-piece contact springs. Such contact springs are used in the so-called solder-free press-in technology in electrical plug-in connectors.

2. Description of the Prior Art

Methods of this type of manufacturing single-piece contact springs from a metal strip are known primarily from DE-patent No. 26 20 757 and DD-patent No. 243 145. These known methods have the significant disadvantage that the overall manufacture of the contact springs is relatively complicated and cumbersome. This is because several deforming operations have to be carried out after the initial punching operation. This punching operation is carried out without forming scrap. The additional deforming operations are carried out in the region of the plane of the strip between the spring arms to be formed.

It is, therefore, the primary object of the present invention to reduce the number of work steps while simultaneously saving material by increasing the number of springs punched out per area unit.

SUMMARY OF THE INVENTION

In accordance with the present invention, single-piece contact springs are made by continuous punching from a metal strip. Each contact spring has in the finished state two spring arms which extend symmetrically relative to each other and are connected to a common connecting member. The spring arms have each a contact bend which are directed toward and are in contact with each other. The other end of the spring has a connecting post preferably provided with a press-in portion. A gap for the later formation of the spring arms is made during one of the punching operations of the blank in the plane of the strip as a scrapless punching cut. Simultaneously with the scrapless punching operation, one of the spring arms is bent out of the plane of the strip near the connecting member and is placed by a stamping operation into a position approximately parallel to the other spring arm which remained in the plane of the strip. In a subsequent deforming operation, the contact bends are formed simultaneously in both spring arms and the spring arms are crossed over each other transversely of the plane of the strip in the region of the contact bends.

The various features of novelty which characterize the invention are pointed out with particularity in the claims annexed to and forming a part of this disclosure. For a better understanding of the invention, its operating advantages and specific objects attained by its use, reference should be had to the drawings and descriptive matter in which there is illustrated and described a preferred embodiment of the invention.

DETAILED DESCRIPTION OF THE INVENTION

Figure 1:
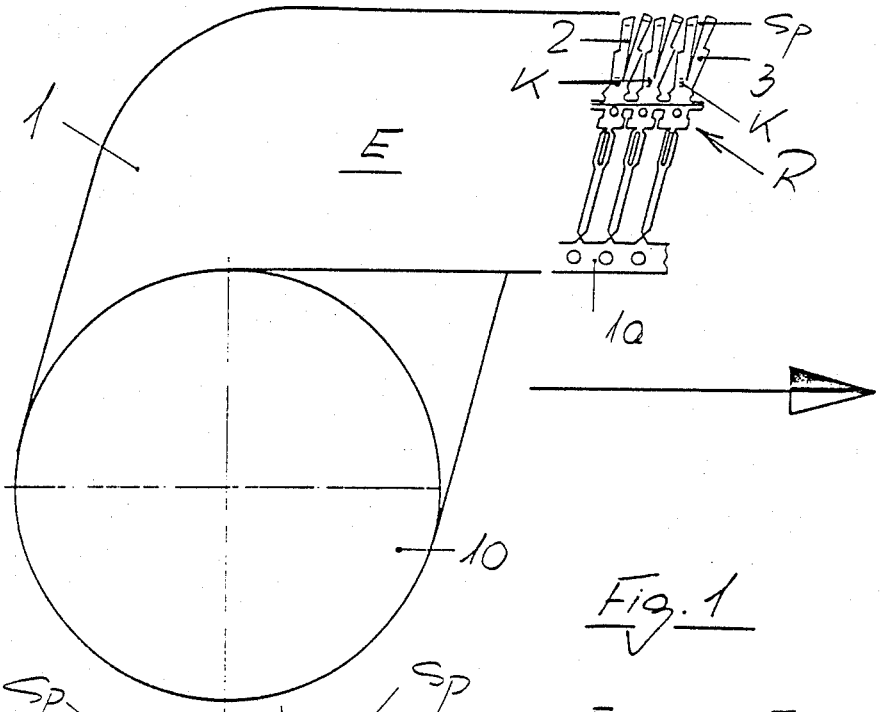
FIG. 1 shows contact spring blanks manufactured by the method according to the present invention, the blanks being on a strip.
Figure 2:
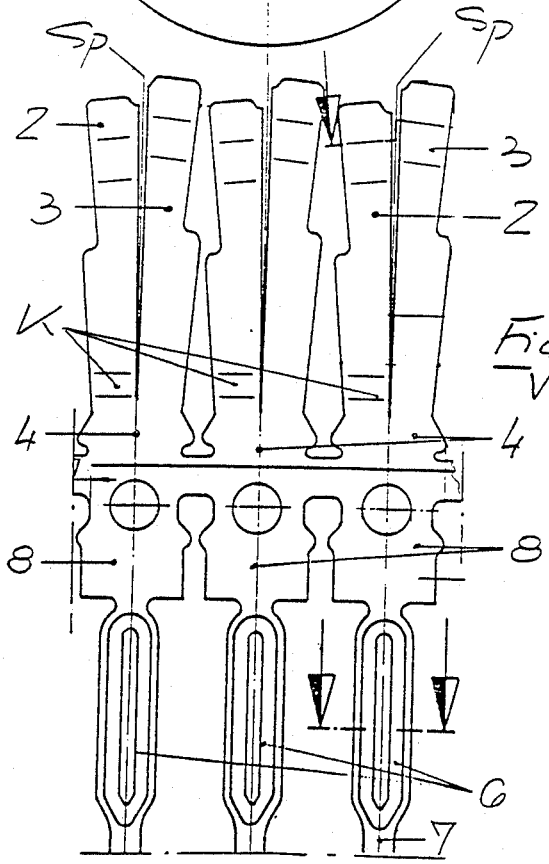
FIG. 2 shows, on a larger scale, the area of the spring arms of the contact springs of FIG. 1.

FIGS. 1 and 2 of the drawing show single-piece contact springs which are manufactured by continuous punching from a metal strip 1. As shown in FIG. 1, the springs remain connected to a strip portion 1*a*. Each contact spring has two spring arms 2, 3 which are connected to a common connecting member 4 and extend in the finished state symmetrically relative to each other. The spring arms 2, 3 each have contact bends 5 which rest against each other. At the other end is a connecting post 7 preferably provided with a press-in portion 6.

The present invention provides that, simultaneously with the punching operation, one of the arms 2 is bent in the area of the connecting member 4 and is placed by a stamping operation into a position E′ approximately parallel to the arm 3 which has remained in the plane E of the strip. Subsequently, in another deforming operation, the contact bends 5 are simultaneously formed in the planes E and E′ of the arms and the arms are crossed over each other in a direction transversely of the planes E and E′ in the region of the contact bends 5, as illustrated particularly in FIG. 3.

Figure 3:
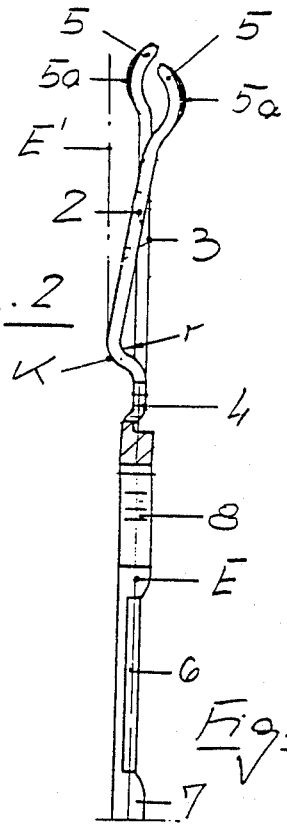
FIG. 3 is a side view of the spring portion shown in FIG. 2.

The contact bends 5 of the spring arms 2 and 3 which, due to the previous crossing over of the arms 2 and 3, face outwardly are now subjected to a galvanic treatment with the contact springs F being in the state illustrated in FIG. 3, i.e., prior to the separation of the springs from strip 1. The galvanic treatment may be, for example, an application of gold 5*a* or the like. Subsequently, the spring arm 3 which is still in plane E is also bent and both arms 2 and 3 are crossed over relative to each other in planes E and E′ and are brought in contact with each other under pretension with the contact bend 5, 5*a*.

The above-described galvanic treatment of the springs on the strip represent a particularly economical manufacturing method.

The preparation of gap Sp in a conventional scrapless punching operation makes possible the economical narrow spacing of 2.54 mm which additionally corresponds to the spacing of the plugs in which these contact springs are to be used.

Figures 4, 6:
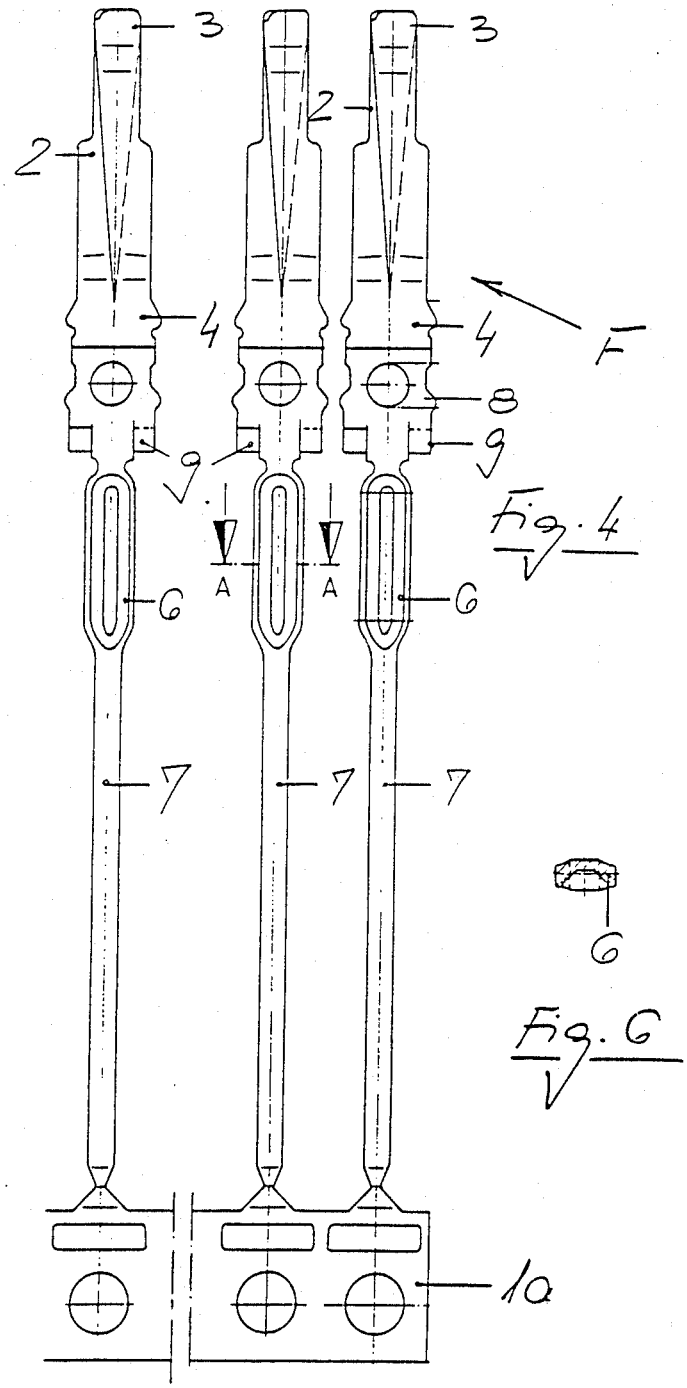
FIG. 4 shows the finished contact springs while still on the strip.
FIG. 6 is sectional view taken along sectional line A—A in FIG. 4.
Figure 5:
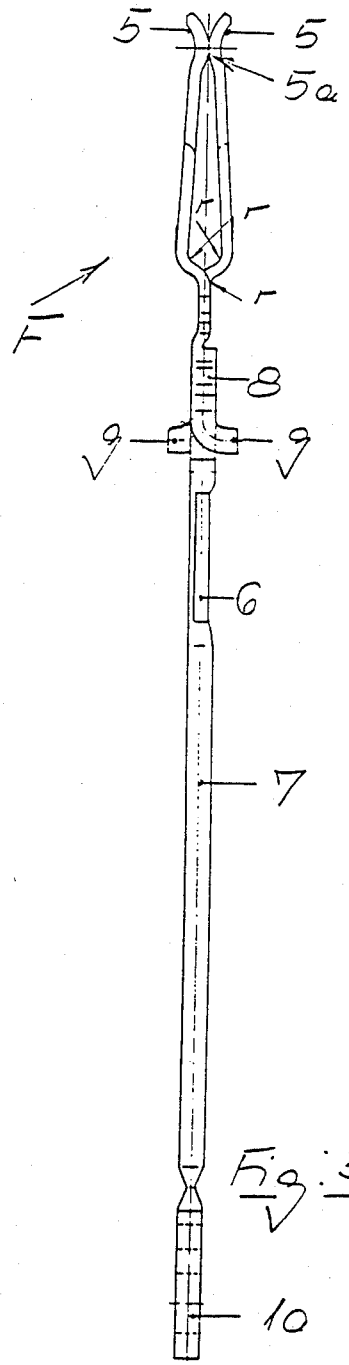
FIG. 5 is a side view of the contact spring portion shown in FIG. 4.

As illustrated in FIGS. 4 and 5, the springs may be provided, as may be required or advantageous in press-in technology, in addition to the press-in portion 6, with two cams 9 or the like as press-in shoulders. Cams 9 are provided above the press-in portion 6 or the web 8 and are bent outwardly in opposite directions.

While a specific embodiment of the invention has been shown and described in detail to illustrate the application of the inventive principles, it will be understood that the invention may be embodied otherwise without departing from such principles.

We claim

1. A method of making single-piece contact springs, each contact spring having in the finished state two spring arms which extend symmetrically relative to each other and are connected to a common connecting member, the spring arms each having a contact bend, the two contact bends being directed toward each other and being in contact with each other, another end of each spring facing away from the spring arms having a connecting post provided with a press-in portion, comprising continuously punching the contact springs from a metal strip and making a gap for the formation of the spring arms in the plane of the strip as a scrapless punching cut, and, simultaneously with the punching step, bending one of the spring arms out of the plane of the strip near the connecting member and placing the one of the spring arms by means of a stamping operation into a position approximately parallel to the other one of the spring arms which remains in the plane of strip, and subsequently carrying out a deforming operation in which the contact bends are formed simultaneously in both spring arms and the spring arms are crossed over each other transversely of the plane of the strip in the region of the contact pins.

2. The method according to claim 1, comprising, prior to separating the contact springs from the strip, galvanically treating the outwardly facing surfaces of the contact bends, and subsequently bending the other one of the spring arms out of the plane of the strip so that both arms are crossed over each other, and bringing the contact bends into contact with each other under pretension.

* * * * *